US006936411B2

(12) United States Patent
Van de Zegel et al.

(10) Patent No.: US 6,936,411 B2
(45) Date of Patent: Aug. 30, 2005

(54) INDUSTRIAL RADIOGRAPHIC SILVER HALIDE MATERIAL SUITABLE FOR RAPID PROCESSING APPLICATIONS

(75) Inventors: Marc Van de Zegel, Boortmeerbeek (BE); Marleen De Vester, Broechem (BE)

(73) Assignee: AGFA-Gevaert, Mortsel (BE)

( * ) Notice: Subject to any disclaimer, the term of this patent is extended or adjusted under 35 U.S.C. 154(b) by 0 days.

(21) Appl. No.: 10/758,577

(22) Filed: Jan. 15, 2004

(65) Prior Publication Data

US 2004/0146814 A1 Jul. 29, 2004

Related U.S. Application Data

(60) Provisional application No. 60/444,974, filed on Feb. 4, 2003.

(30) Foreign Application Priority Data

Jan. 15, 2003 (EP) ..... 03100059

(51) Int. Cl.[7] ..... G03C 1/047; G03C 1/30; G03C 1/46; G03C 5/16

(52) U.S. Cl. ..... 430/350; 430/428; 430/501; 430/502; 430/539; 430/621; 430/622; 430/628; 430/640; 430/966; 430/967

(58) Field of Search ..... 430/350, 428, 430/501, 502, 539, 621, 622, 628, 640, 966, 967

(56) References Cited

U.S. PATENT DOCUMENTS 5,370,977 A 12/1994 Zietlow ..... 430/502
5,445,927 A * 8/1995 Florens et al. ..... 430/502
5,518,868 A * 5/1996 Florens et al. ..... 430/429
5,620,836 A * 4/1997 Heremans et al. ..... 430/496
6,291,153 B1 * 9/2001 Dickerson ..... 430/567
6,316,175 B1 * 11/2001 Van den Zegel et al. ... 430/502

FOREIGN PATENT DOCUMENTS

| | | |
|---|---|---|
| EP | 0 622 668 | 2/1994 |
| EP | 0 620 482 | 10/1994 |
| JP | 4-19648 | 1/1992 |

* cited by examiner

*Primary Examiner*—Richard L. Schilling
(74) *Attorney, Agent, or Firm*—Joseph T. Guy; Nexsen Pruet LLC

(57) ABSTRACT

A silver halide industrial radiographic material comprising on at least one side of a support a hydrophilic gelatinous non-spectrally sensitized radiation-sensitive emulsion layer, having grains, coated in a total amount in the range from 6 to 20 g, expressed as an equivalent amount of silver nitrate per square meter, and at least one non-radiation sensitive protective gelatinous antistress overcoat layer thereupon, wherein a ratio of gelatin to silver, expressed as silver nitrate in the said layer arrangement is at least 0.70, wherein said gelatinous layers are hardened by a gelatin cross-linking agent in an amount in order to have a dissolving time of at least 40 minutes, said time being defined as the period of time from the moment when the silver halide photographic material, dipped into 50 ml of an aqueous solution of 1.5% by weight of sodium hydroxide at 50° C., until the moment that the base becomes visible due to dissolving of the layers coated thereupon, is characterized by a hydrophilic gelatinous layer arrangement wherein a hydrophilic polymer is present in an amount of at least 1 g per $m^2$.

46 Claims, No Drawings

INDUSTRIAL RADIOGRAPHIC SILVER HALIDE MATERIAL SUITABLE FOR RAPID PROCESSING APPLICATIONS

DESCRIPTION

This application claims the benefit of Provisional Application No. 60/444,974, filed Feb. 4, 2003.

FIELD OF THE INVENTION

The present invention relates to a silver halide photographic industrial X-ray film and a method of forming an image in said industrial X-ray film by the processing of said exposed film in automatic processing machines.

BACKGROUND OF THE INVENTION

For industrial radiography a normal processing cycle is characterized by the following steps: transport of the film through the developer at 28° C., transport through the fixer at 26° C., transport through a rinsing bath and transport through the drying station. This normally takes a total processing time of about 8 minutes dry-to-dry. In order to decrease the total processing time, in order to approach a more desired "rapid processing" ability for requested more rapid examination ability, lowering of the gelatin amount coated, is a measure providing reduction of total processing time cycles from 8 minutes to 5 minutes. If an automatic processing machine is used therefor, film transport is made possible by the racks, each of which is provided with a lot of rollers immersed in different processing baths. In the said automatic processing machine "pressure sensitivity", more particularly with materials having thinner vulnerable gelatin layers, becomes visible as a black dot or line in the processed material, thus disturbing or even making unambiguous examination impossible. More in detail it has been observed that pressure marks occur, in the processing steps, by contact of the material in the developer rack or in the so-called "cross-over step" from developer to fixer. This problem becomes more and more stringent when in the coated light-sensitive layers a decreasing ratio of gelatin to coated silver is calculated.

Coating materials with increased amounts of gelatin in the coating layers (thereby increasing the so-called "gesi" or ratio by weight of gelatin to silver) in order to avoid pressure marks may cause drying problems (as has discussed in EP-A 0 698 817) and may moreover cause "sludge" in the processing solutions during processing. This problem could be solved by addition of increased amounts of hardeners while coating the material, but other problems like loss in speed may occur. Further measures in order to compensate for the said loss in speed, like increasing the average size of the emulsion grains or crystals, however lays burden on the desired gradation or contrast, which is expected to decrease to an undesired level and which may cause image quality to deteriorate. Use of emulsions having silver bromoiodide emulsion grains, provided with a heterogeneous iodide distribution over the grain volume, in that a slightly increased amount of iodide is provided at the surface of the grains, may be in favor of less pressure sensitivity, but presence of iodide in higher concentrations in the outermost layers of silver halide emulsion grains may however lay burden on the developability of the grains and loss in speed or loss in rapid processing applicability. Moreover fixation of grains enriched with iodide at the grain surface may be worse, so that fixation times during processing may increase.

OBJECTS AND SUMMARY OF THE INVENTION

It has been an object of the present invention to provide a silver halide photographic film material for industrial non-destructive testing applications with low amounts of water absorption (excellent hardening properties) before entering the drying section of the processing cycle and without black dots or lines due to pressure sensitization, without loss in speed or sensitivity.

A further object of the present invention is to substantially decrease the total processing time dry-to-dry (more particularly shorter total processing times in the range of 5 minutes instead of the commonly applied 8 minutes cycle) for materials having thin, vulnerable layers as discussed before, without causing pressure sensitization to become a critical, disadvantageous feature.

Other objects will become apparent from the description hereinafter.

The above-mentioned advantageous effects have been realized by a material for non-destructive testing applications having the specific features set out in claim 1. Specific features for preferred embodiments of the invention are set out in the dependent claims.

Further advantages and embodiments of the present invention will become apparent from the following description.

DETAILED DESCRIPTION OF THE INVENTION

According to the present invention a silver halide industrial photographic X-ray material has been disclosed essentially comprising an enhanced amount of hardening agent in order to cross-link increased gelatin amounts in the coated hydrophilic layers of the layer arrangement of the said material, and wherein, in order to provide the desired speed level after rapid processing of the said material, a polysacharide (as dextran) and/or polyacrylamide has been added as a polymeric component to the coated emulsion layer: according to the present invention the hydrophilic polymer is indeed selected from the group consisting of polysaccharides and polyacrylamides, having an average molecular weight of less than 100000 and, more preferably, less than 50000 (e.g. about 40000). According to the present invention, in a preferred embodiment, said polysaccharide is dextran, having a molecular weight in the range from 1000 to less than 40000, and more preferably in the range from 1000 up to 20000.

As a gelatin cross-linking agent, providing the desired hardening of the material of the present invention, a vinyl sulfonyl hardening agent is added, and in a more preferred embodiment said vinyl sulfonyl hardening agent is bis-(vinyl-sulfonyl)-methane, present in an amount of at least 150 mg per sq.m. of the said material.

In the embodiment according to the present invention wherein the industral radiographic material is double-side coated, it is preferred to have a symmetrical layer arrangement, wherein at both sides same corresponding layers have the same composition.

With respect to the layer arrangement to which a specific amount of hardener is added, it is clear that said layer arrangement comprises at least one non-spectrally sensitized radiation-sensitive emulsion layer, having grains, coated in a total amount in the range from 6 to 20 g, expressed as an equivalent amount of silver nitrate per square meter, and at least one non-radiation sensitive protective gelatinous anti-stress overcoat layer, wherein a ratio of gelatin to silver, expressed as silver nitrate in the said layer arrangement is at least 0.70. Besides optional presence of a second radiation-sensitive emulsion layer, it is clear that, optionally, two protective layers are present or, in the alternative, an intermediate hydrophilic gelatinous layer between the emulsion layer (or, optionally, the emulsion layer farthest from the support) and the protective antistress layer (whether or not consisting of two protective layers). Otherwise it is not excluded to have, in the said layer arrangement, one or two intermediate layer(s) between the subbed support (thus between the subbing layer) and the emulsion layer (or, in case of more than one emulsion layer, the emulsion layer more close to the support). In a particular embodiment wherein two emulsion layers are present, it is even not excluded to have an intermediate layer between the said emulsion layers.

As a specific feature of the present invention it should however be understood that a ratio of gelatin to silver, expressed as silver nitrate in the said layer arrangement (inclusive for all hydrophilic gelatinous layers coated thereupon at one (or each—in case of a double-side coated material) side of the support is at least 0.70.

As an advantageous effect of the present invention automatic processing within a time of 5 minutes instead of 8 minutes is allowed. The vinyl sulphone compound as a hardening agent mentioned hereinbefore is the preferred hardening agent, providing a "dissolving time" of the coated material of at least 40 minutes (by the test method, described hereinafter), wherein said "dissolving time", in a further preferred embodiment, is at least 50 minutes, even more preferred more than 70 minutes and, most preferred, between 90 and 240 minutes as will be illustrated in the examples hereinafter.

Accordingly a ratio of gelatin in the hydrophilic gelatinous layer arrangement to silver in the coated emulsion layer(s) of the material according to the present invention is at least 0.70 and, more preferably, in the range from 0.70 up to 1.20. Taking amounts of gelatin present in the radiation-sensitive emulsion layer(s) apart, a ratio of gelatin to silver is lower, e.g., in the range from 0.50 up to 1.00.

A preferred amount of a polysaccharide as a hydrophilic polymer (especially when dextran is applied as a preferred additive) added to the hydrophilic gelatinous layer arrangement of the material according to the present invention, is at least 1 g per $m^2$ (and per side in case of double-side coated materials), more preferably in the range from 2 g up to 6 g per $m^2$. Before coating of the multilayer material of the present invention the said hydrophilic polymer may be added to whatever a hydrophilic gelatinous layer of the said hydrophilic gelatinous layer arrangement. Preferred however is presence of the said hydrophilic polymer in the coating solution of the radiation-sensitive layer (or layers, if present). Presence in the protective antistress coating layer (or an intermediate layer defined above) is however not excluded.

So according to the present invention said hydrophilic polymer is present in the material in a weight ratio versus gelatin in the range from 1:10 to 1:2 at the side of the radiation-sensitive emulsion layer (or at both sides in case of a double-side coated material).

In the light-sensitive emulsion layers of the material according to the present invention cubic silver bromoiodide emulsion grains are preferred, said grains having an average equivalent volume diameter of at least 0.40 $\mu$m (more preferably in the range from 0.50 $\mu$m up to 2.00 $\mu$m, in view of speed or sensitivity) and a homogeneity, defined as ratio of standard deviation of the said equivalent volume diameter and the said average equivalent volume diameter, of at most 0.25, and more preferably less than 0.20.

Moreover in the light-sensitive emulsion layers of the material according to the present invention cubic silver bromoiodide emulsion grains having silver iodide in a molar amount of less than 3 mole %, based on silver, and more preferably even less than 1.5 mole % (more particularly in favor of more rapid fixation).

As a procedure in order to evaluate the degree of hardening of a hardened layer of a coated radiation-sensitive photographic material, it is well known in the field of the art to look at the degree of swelling of a hardened layer after immersing the layer in an aqueous solution, or to know the scratch strength of a hardened layer shown by a load which causes scratches on the swollen layer when the hardened layer is loaded with a gradually increased pressure, applied onto the load. However, for the evaluation within the context of the objects of the present invention as envisaged, it is most effective to immerse a hardened layer in a solution kept at a definite temperature and evaluating the hardened extent, making use of the "dissolving time" as a measurable parameter, being the time until the "solid" layer begins to dissolve, so that it becomes transparent and releases from the material support: it is most convenient to perform the measurement of the "dissolving time" of hardened layers of a coated material in an aqueous solution of 1.5% by weight of sodium hydroxide at 50° C., until the moment that the base becomes visible, due to dissolving of the layers coated thereupon, as will be described more in detail in the examples hereinafter.

The hardening agent may be added to the coating composition of the emulsion layer(s) and/or to the coating composition of the protective antistress layer(s) before or during the coating procedure. If the hardener is added during the coating procedure it is still possible to make corrections for the water absorption of the material that still has to be coated, by controlling the amount of water absorption for the already coated material directly after coating.

Preferred amounts of hardeners according to the present invention are between about at least 100 and 600 mg per square meter and per side of the film support, and more preferably at least 150 mg per square meter, per side of the film support coated with a layer arrangement as defined hereinbefore.

Light-sensitive layers of the silver halide industrial photographic X-ray material according to the present invention comprise the silver halide emulsions. In accordance with the present invention the silver halide emulsions coated in the silver halide emulsion layer(s) may comprise silver chloride, silver chlorobromide, silver chlorobromoiodide, silver bromide and silver bromoiodide. Suitable silver chloride and silver chlorobromide emulsions may be those that have e.g. been described in EP-A 0 538 947. Besides silver halide grains having a cubic habit, grains having a {100} or {111} tabular habit may be used, whether or not provided with epitaxial deposits. In a preferred embodiment however the said silver halide emulsions coated in the silver halide emulsion layer(s) of the industral radiographic material of the present invention comprise grains rich in silver bromide having iodide in an amount of less than 3 mole %, and more preferably less than 1.5 mole %. It is preferred to use regular-shaped silver halide crystals and more particularly silver bromoiodide emulsions with a cubic crystal habit which are commonly used in industrial radiographic materials as those grains or crystals are known for their excellent development characteristics, thereby providing high sensitivity and an excellent speed-fog relationship. During the precipitation stage of the emulsion making the parameter determining whether cubic or octahedral crystals are formed is the pAg of the solution. The pAg of the solution may be regulated by any of the means known in the art of emulsion making, such as the electronic control apparatus and method disclosed in U.S. Pat. No. 3,821,002. From the article "Der Einfluβ der Wachstumsbedin-gungen auf die Kristalltracht der Silberhalogenide" (the influence of Growth Conditions on the Crystalline Behavior of Silver halides) von E. Moisar and E. Klein, Bunsengesellschaft fur physikalische Chemie, Berichte 67 949–957 (1963) No 9/10, it is known that on allowing tetradecahedral crystals of a homodisperse silver bromide emulsion to grow by controlled addition of solutions of silver nitrate and potassium bromide, crystals of cubic form are obtained under conditions of low excess bromide concentration in the solution phase. A preferred embodiment of making the emulsions used according to the present invention involves the preparation of high-sensitive silver bromoiodide emulsions as these X-ray emulsions, by precipitation under controlled double jet conditions. Although nowadays processes for the preparation of homogeneous silver halide emulsions make use of special control devices to regulate the form of the resulting silver halide crystals, said form mainly being determined by the pAg value and temperature in the reaction vessel, the silver ion concentration can be kept constant during the precipitation by the use of a special inlet technique as described in Research Disclosure 10308.

In order to obtain a reproducible crystal size especially the flow rate and concentration of the solutions, the temperature and pAg have to be adjusted very carefully. Grain-growth restrainers or accelerators may be added from the start or during the preparation of the emulsion crystals. Depending on the initial conditions during precipitation, monodispersed emulsions can be prepared as is preferred for the present invention. Monodispersed emulsions in contrast to heterodispersed emulsions have been characterized in the art as emulsions of which at least 95% by weight or number of the grains have a diameter which is within about 40%, preferably within about 30% of the mean grain-diameter and more preferably within about 10% to 20%.

Silver halide grains having a very narrow grain-size distribution can thus be obtained by strictly controlling the conditions at which the silver halide grains are prepared using a double jet procedure. In such a procedure, the silver halide grains are prepared by simultaneously running an aqueous solution of a water-soluble silver salt for example, silver nitrate, and water-soluble halide, for example, a mixture of potassium bromide and potassium iodide, into a rapidly agitated aqueous solution of a silver halide peptizer, preferably gelatin, a gelatin derivative or some other protein peptizer. Even colloidal silica may be used as a protective colloid as has been described in EP-A 0 392 092 and in the EP-A 0 649 051, particularly related with the preparation cubic silver brom(oiod)ide emulsions as envisaged in the materials of the present invention.

In a preferred embodiment the rates of addition of the silver nitrate and halide salt solutions are steadily increased in such a way that no renucleation appears in the reaction vessel. This procedure is especially recommended, not only to save time but also to avoid physical ripening of the silver halide crystals during precipitation, the so-called Ostwald ripening phenomenon, which gives rise to the broadening of the silver halide crystal distribution.

In order to improve sensitivity addition of dopants in form of metal ions, (inorganic, organic or mixed organic and inorganic complexes of the said metal ions (especially those of group VIII of the Periodic System of the elements) during and/or at the end of precipitation may be applied. In a particular embodiment e.g. organic hole trapping dopants as e.g. those described in EP-A 0 922 994 and 1 271 233 may be useful.

Once the grains have reached their ultimate size and shape, the emulsions are generally washed to remove the by-products of grain-formation and grain-growth. In order to remove the excess of soluble salts washing is applied at a pH value which can vary during washing but remains comprised between 3.7 and 3.0 making use of a flocculating agent like polystyrene sulphonic acid. The emulsion may be washed by diafiltration by means of a semipermeable membrane, also called ultrafiltration, so that it is not necessary to use polymeric flocculating agents that may disturb the coating composition stability before, during or after the coating procedure. Such procedures are disclosed e.g. in Research Disclosure Vol. 102, October 1972, Item 10208, Research Disclosure Vol. 131, March, Item 13122 and Mignot U.S. Pat. No. 4,334,012. Preferably, at the start of the ultrafiltration, there is no pH and pAg adjustment as pH and pAg are maintained at the same level as at the end of the preceding precipitation without any adjustment stage.

According to the present invention, the emulsions are preferably washed by acid-coagulation techniques using acid-coagulable gelatin derivatives or anionic polymeric compounds or, when precipitation occurred in silica medium, by certain polymers capable of forming hydrogen bridges with silica, in an amount sufficient to form coagulable aggregates with the silica particles as has been described e.g. in EP-A 0 517 961.

Coagulation techniques using acid-coagulable gelatin derivatives have been described e.g. in U.S. Pat. Nos. 2,614,928; 2,614,929 and 2,728,662. The acid-coagulable gelatin derivatives are reaction products of gelatin with organic carboxylic or sulphonic acid chlorides, carboxylic acid anhydrides, aromatic isocyanates or 1,4-diketones. Use of these acid-coagulable gelatin derivatives generally comprises precipitating the silver halide grains in an aqueous solution of the acid coagulable gelatin derivative or in an aqueous solution of gelatin to which an acid coagulable gelatin derivative has been added in sufficient proportion to impart acid-coagulable properties to the entire mass. Alternatively, the gelatin derivative may be added after the stage of emulsification in normal gelatin, and even after the physical ripening stage, provided it is added in an amount sufficient to render the whole coagulable under acid conditions. Examples of acid-coagulable gelatin derivatives suitable for use in accordance with the present invention can be found e.g. in the United States Patent Specifications referred to above. Particularly suitable are phthaloyl gelatin and N-phenyl-carbamoyl gelatin.

The coagulum formed may be removed from the liquid by any suitable means: for example the supernatant liquid is decanted or removed by means of a siphon, where upon the coagulum is washed out once or several times. Washing of the coagulum may occur by rinsing with mere cold water. However, the first wash water is preferably acidified to lower the pH of the water to the pH of the coagulation point. Anionic polymer e.g. polystyrene sulphonic acid may be added to the wash water even when an acid coagulable gelatin derivative has been used e.g. as described in published DE-A 2,337,172 mentioned hereinbefore. Alternatively washing may be effected by redispersing the coagulum in water at elevated temperature using a small amount of alkali, e.g. sodium or ammonium hydroxide, recoagulating by addition of an acid to reduce the pH to the coagulation point and subsequently removing the supernatant liquid. This redispersion and recoagulation operation may be repeated as many times as required.

After the washing operation, the coagulum is redispersed in order to form a photographic emulsion suitable for the subsequent finishing and coating operations by treating, preferably at a temperature within the range of 35° to 70° C., with the required quantity of water, gelatin and, if necessary, alkali for a time sufficient to effect a complete redispersal of the coagulum.

Instead or in addition to normal gelatin, which is preferably used, other known photographic hydrophilic colloids can also be used for redispersion as e.g. a gelatin derivative as referred to above, albumin, agar-agar, sodium alginate, hydrolysed cellulose esters, polyvinyl alcohol, hydrophilic polyvinyl copolymers, colloidal silica, cationic starch, etc.

The preferred light-sensitive silver bromoiodide emulsions are chemically sensitized with a sulphur and gold sensitizer, and, optionally, a selenium sensitizer. This can be done as described i.a. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature sulphur sensitization can be carried out by effecting the ripening in the presence of small amounts of compounds containing sulphur and/or selenium e.g. thiosulphate, thiocyanate, thioureas, sulphites, mercapto compounds, and rhodamines. Gold sensitization occurs by means of gold compounds, as described e.g in EP-A 1 197 797. In addition small amounts of compounds of Ir, Rh, Ru, Pb, Cd, Hg, Tl, Pd or Pt can be used. The emulsion can be sensitized in addition by means of reductors e.g. tin compounds as described in GB-A 789,823, amines, hydrazine derivatives, formamidine-sulphinic acids, and silane compounds. Selenium sensitization, if applied, is carried out as described in EP-A's 0 831 363, 0 889 354 and 1 195 642. Combinations of compounds providing sulphur, selenium and gold ripening are particularly recommended.

If more than one silver bromoiodide emulsion is used in one or more emulsion layers, the said bromoiodide emulsions are chemically ripened separately.

As has been set forth in EP-A 0 555 897 the image tone can be improved by making mixtures of chemically ripened cubic monodisperse silver bromoiodide crystals and chemically ripened cubic monodisperse silver chloride and/or silver chlorobromide and/or silver chlorobromoiodide emulsion crystals, wherein the added non-silverbromoiodide crystals have also been ripened separately.

According to the present invention compounds for preventing the formation of fog or stabilizing the photographic characteristics during the production or storage of photographic elements or during the photographic treatment thereof may be supplementary added. Examples of such stabilizers are heterocyclic nitrogen-containing stabilizing compounds as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercaptotetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-A 75–39537, and GB-A 1,500,278, and-7-hydroxy-s-triazolo-[1,5-a]-pyrimidines as described in U.S. Pat. No. 4,727,017, and other compounds such as benzenethiosulphonic acid, benzene-thiosulphinic acid, benzenethiosulphonic acid amide and other disulfide derivatives, which are giving an unsatisfactory result if added as the sole stabilizing agent and are therefore combined with other stabilizers belonging to the classes of stabilizers already mentioned. On the other hand mercury salts and other metal-salts that can be used as fog-inhibiting compounds such as cadmium salts and related compounds described in Research Disclosure No. 17643 (1978), Chapter VI, should be avoided for reasons of ecology. Very suitable for use as a stabilising agent, more particularly in view of latent image stability is presence of a substituted phenylmercaptotetrazole compound, and more preferably an acetamidophenyl mercaptotetrazole compound, according to the formula represented in the detailed description and in the claims of EP-Application No. 01000570, filed Oct. 25, 2001.

The weight ratio of gelatin to silver halide (expressed as an equivalent amount of silver nitrate) in the radiation-sensitive silver halide emulsion layers of the photographic material according to the present invention is generally comprised between 0.3 and 1.2, preferably between 0.70 and 1.0.

For industrial radiography the silver halide emulsion layer(s) comprise total amounts of silver halide, coated per side and per square meter of from 6 to 20 g, expressed as equivalent amounts of silver nitrate.

The photographic elements under consideration may further comprise various kinds of surface-active agents in the photographic emulsion layer and/or in at least one other hydrophilic colloid layer. Preferred surface-active coating agents are compounds containing perfluorinated alkyl groups. Other suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, siliconepolyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 and other related development accelerators such as those described in e.g. U.S. Pat. Nos. 3,038,805; 3,129,100; 3,158,484; 3,210,192; 3,947,273; 4,013,471; 4,038,075; 4,072,526; 4,292,400 and 4,267,263, without however being limited thereto.

The photographic elements may further comprise various other additives such as e.g. compounds improving the dimensional stability of the photographic element, UV-absorbers, spacing agents and plasticizers.

Suitable UV-absorbers are i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 $\mu$m. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

The photographic element can comprise an antistatic layer e.g. in order to avoid static discharges during coating, processing and other handlings of the material. Such antistatic layer can be an outermost coating or stratum of one or more antistatic agents or a coating applied directly to the film support. Said antistatic layer(s) may be overcoated with a barrier layer of e.g. gelatin. Antistatic compounds suitable for use in such layers are e.g. vanadium pentoxide sols, tin oxide sols or conductive polymers such as polyethylene oxides, polymer latices and the like, but most preferred is use of "poly ethylene dioxy thiophene" (PEDT) in the subbing layer of the material according to the present invention as has been described in EP-A's 0 553 502 and 0 602 713, and in EP-Application No. 02100054, filed Jan. 23, 2002.

The photographic material according to the present invention is preferably a duplitized material having on both sides of the film support at least one emulsion layer and at least one protective antistress layer. The said emulsion layers are preferably overcoated with one protective antistress topcoat layer, the cross-linkable binder of said topcoat layer being hardened with a vinyl sulphonyl type hardener according to this invention as described hereinbefore. Preferably said protective antistress topcoat layer comprises at least one polyoxyalkylene compound as a surfactant.

The support of the photographic material in accordance with the present invention may be a transparent resin, preferably a blue colored polyester support like polyethylene terephtalate. The thickness of such organic resin film is preferably about 175 $\mu$m. The support is provided with a substrate layer at both sides to have good adhesion properties between the emulsion layer and said support.

A further fine-tuning of the outlook of the film may be required. Therefore the absorption spectrum of the material as obtained after the processing cycle described hereinafter may be obtained by the addition of suitable non-migratory dyes to the subbing layer, the emulsion layer(s) or the protective antistress layer(s) or to the topcoat layer at both sides of the support. A blue colored dye is therefore especially recommended.

The photographic industrial X-ray material can be imagewise exposed by means of an X-ray radiation source the energy of which, expressed in kV, depends on the specific application. A typical radiation source is e.g. a radioactive $Co^{60}$ source. In order to reduce the effect of scattering radiation a metal screen, usually a lead screen, is used in combination with the photographic film. Moreover, the generation of secondary electrons enhances the sensitivity.

According to the present invention a method of processing the material described in detail hereinbefore has been provided, wherein said material, after having been exposed to X-rays having an energy in the range from 10 keV to 4 MeV, is processed by the steps of developing, fixing, rinsing and drying, wherein said processing proceeds within a time of less than 5 minutes dry-to-dry.

The processing of the exposed materials having the features as claimed in the present invention, more particularly with respect to hardening properties, is particularly suitable to be applied in hardener-free processing.

As is well-known by anyone skilled in the art, processing conditions and composition of processing solutions are dependent from the specific type of photographic material. For example, according to the present invention materials for industrial X-ray diagnostic purposes make use of an automatically operating processing apparatus, which is, in a preferred embodiment, provided with a system for automatic regeneration of the processing solutions. Applications within total processing times of 90 seconds are possible. From an ecological point of view it is even possible to use sodium thiosulphate instead of ammonium thiosulphate in the fixer.

Furthermore a method of image formation in said silver halide photographic materials of the present invention is advantageously applied as has been given in EP-A's 0 620 484 and 0 621 506. So in the said method, after exposure to direct X-rays said material is subjected, in an automatic processing machine, to the steps of developing in a developer comprising as a surfactant at least one anionic alkylphenoxy and/or alkoxy polyalkyleneoxy phosphate ester, sulphate ester, alkyl carboxylic, sulphonic or phosphonic acid and/or a salt thereof, fixing in a fixer which may comprise at least one $\alpha$-ketocarboxylic acid, rinsing and drying.

It is clear that the improvements stated for industrial X-ray films will also apply to X-ray medical films of high silver halide content.

While the present invention will hereinafter be described in connection with preferred embodiments thereof, in following examples illustrative for the invention, it will be understood that it is not intended to limit the invention to those specific embodiments.

EXAMPLES

Example No. 1

Preparation of a chemically ripened gelatino silver bromoiodide X-ray emulsion comprising 99 mole % of silver bromide and 1 mole % of silver iodide, based on silver.

An aqueous solution containing 3 grams of ammonia was added to the reaction vessel containing 1550 ml of a 3% by weight aqueous solution of gelatin at 45° C.

Into said reaction vessel a solution of 2000 ml of an aqueous 1.5 molar solution of potassium bromide and a solution of 2000 ml of an aqueous 1.5 molar solution of silver nitrate were introduced at constant rate of 86 ml/min under vigorously stirring conditions.

During precipitation the pAg value was adjusted to and maintained at a value of +58 mV measured with a Ag electrode with reference to a Ag/AgCl(3M KCl) electrode.

In this way homogeneous and regular silver halide grains having a crystal diameter of 0.54 $\mu$m were obtained.

At the end of the precipitation step, the emulsion was coagulated by adding polystyrene sulphonic acid acting as a flocculating agent after adjustment of the pH value of the emulsion in the reaction vessel to 3.5 with sulphuric acid.

After rapid sedimentation of said silver halide emulsion the supernatant liquid was decanted.

In order to remove the water-soluble salts from said flocculate, demineralized water of 11° C., was added under controlled stirring conditions followed by a further sedimentation and decantation.

This washing procedure was repeated until the emulsion was sufficiently desalted.

Thereafter the coagulum was re-dispersed at 45° C. in water after the addition of a sufficient amount of gelatine to obtain a ratio of gelatine to silver halide expressed as silver nitrate of 0.4.

The pH-value was adjusted to 6.0 and pAg to a value of +165 mV.

Chemical sensitisation of said emulsion was performed by the addition of a sulphur and gold sensitizers and digestion at 50° C. to the point where the highest sensitivity was reached for a still acceptable fog level.

Composition of the Coating Solution of the Emulsion Layer:

Compounds added to the chemically ripened silver bromoiodide emulsion, in grams per $m^2$, have been given in the Table I.

TABLE I

| Compound | Amount in $g/m^2$ |
|---|---|
| Gelatin | As indicated in table III. |
| Hydrophilic polymer not reacting with added hardener: compound I | As indicated in table III. |
| 4-hydroxy-6-methyl-1,3,3a,7-tetraazaindene | 0.064 |
| Resorcinol | 0.298 |
| Bis-metasulphophenyl-disulphide | 0.020 |

Compound I = dextran MW = 10.000 (Amersham Pharmacia Biotech ™)

Composition of the Coating Solution of the Protective Layer:

Composition in g per $m^2$ after coating (see Table II hereinafter):

TABLE II

| Compound | Amount in $g/m^2$ |
|---|---|
| Gelatin | 1.89 |
| Polymethylmethacrylate spacing agent (average particle diameter: 3 mm) | 0.011 |
| $CF_3$—$(CF_2)_6$—CONH—$(CH_2CH_2O)_{17-20}$—H: | 0.020 |
| Mobilcer Q (a paraffin wax, trade name product from MOBIL OIL) | 0.023 |
| Polythioether A (modified poly-epichlorohydrine having an average chain length of approximately 20 monomer units and of which about 50% of the chloride groups have been replaced by a —S—$CH_2$—CHOH—$CH_2OH$ substituent) | 0.042 |
| Bis-vinyl-sulphonyl-methyl ether (added just before coating) (DVS) | As indicated in table III. |

Coating of the Materials

The photographic materials according to these examples comprise one emulsion layer and one protective layer, coated symmetrically in the same way at both sides of a blue colored polyethylene terephthalate support having a density for white light of 0.150 and a thickness of 175 $\mu$m.

The coating solution of the emulsion layer was prepared by adding solutions of the compounds indicated in Table I to the emulsions dissolved while heating and stirring.

The coating solution of the protective layer has been given in Table II.

The emulsion layer and the protective layer were coated simultaneously on one side of the subbed polyester support, mentioned herein before by means of the conventional slide hopper coating techniques.

The silver coverage of the emulsions was 13.25 $g/m^2$, expressed as equivalent amount of $AgNO_3/m^2$ per side.

Exposure Conditions, Processing Conditions and Determination of Sensitometric Parameters.

Samples of said coated and dried films were exposed according to ISO7004 with a 220 kV radiation source with a copper filter of 8 mm thickness.

The exposed samples were developed, fixed, rinsed and dried in an automatic processing machine, called Stucturix NDT-S, marketed by Agfa-Gevaert. The processing cycle was 8 minutes; the developer temperature was 28° C. Developer and fixer solutions were the commercially available Agfa-Gevaert NDT G135 and G335 respectively.

After processing the speed was determined:

Speed: measured as the log E value at a density of Dmin+2.0 (a lower figure is representative for a higher speed).

Determination of Wet Pressure Lines:

Samples (18×24 cm) of the test materials were exposed uniformly with X-ray (220 kV) so that after processing in the above described conditions a density of 2.00 was obtained.

In order to create a slight pressure on the film during developing, a ribbed guiding plate on the lower side of the developer rack was folded closer to the film. This was resulting, after processing, in black lines on the film materials. The level of blackening was classified into 5 levels in which "0" corresponds to no black lines and "5" to clear black lines.

Determination of Dissolving Time in NaOH Solution:

The dissolving time is defined as the period of time from the moment when the silver halide photographic material, cut into a size of 4 cm×3.5 cm, is dipped into 50 ml of an aqueous solution (1.5% by weight) of sodium hydroxide at 50° C., until the moment that the base becomes visible due to dissolving of the layers coated thereupon.

Determination of Water Content:

Samples of size 274×35 mm of the test materials were dipped into water of 24° C. during 10 minutes and were weighted (=$G_{wet}$) after removal of the surface water.

After 20 minutes of drying at 20° C. and 50% relative humidity the samples were re-weighted (=$G_{dry}$)

The water content was then calculated as:

$(G_{wet}-G_{dry})/(0.274\times0.035)$ and is expressed in $g/m^2$.

Results of the evaluations have been summarized in the Table III hereinafter.

TABLE III

| Material No. | Gelatin In emulsion layer ($g/m^2$) | Compound I ($g/m^2$) | Hardener DVS | Speed | Wet pressure lines | Dissolving Time in NaOH-sol (min.) | Water content ($g/m^2$) |
|---|---|---|---|---|---|---|---|
| 1 | 9.23 | 0.00 | 0.13 | 1.59 | 5.0 | 26.0 | 50.70 |
| 2 | 8.0 | 0.00 | 0.13 | 1.56 | 7.0 | 26.0 | 45.04 |
| 3 | 13.0 | 0.00 | 0.13 | 1.61 | 4.0 | 15.5 | 76.16 |
| 4 | 13.0 | 1.96 | 0.13 | 1.56 | 4.0 | 13.4 | 95.27 |
| 5 | 8.0 | 3.92 | 0.13 | 1.46 | 7.0 | 21.0 | 66.39 |
| 6 | 10.5 | 3.92 | 0.13 | 1.48 | 5.0 | 15.2 | 84.52 |
| 7 | 13.0 | 3.92 | 0.13 | 1.52 | 4.0 | 12.4 | 107.17 |
| 8 | 10.5 | 0.00 | 0.33 | 1.70 | 3.0 | 72.0 | 37.77 |
| 9 | 8.0 | 1.96 | 0.33 | 1.58 | 3.5 | 74.4 | 38.18 |
| 10 | 13.0 | 3.92 | 0.33 | 1.60 | 2.0 | 50.1 | 68.31 |
| 11 | 8.0 | 0.00 | 0.52 | 1.69 | 2.5 | 234.0 | 22.96 |
| 12 | 13.0 | 0.00 | 0.52 | 1.74 | 1.0 | 136.0 | 38.34 |

TABLE III-continued

| Material No. | Gelatin In emulsion layer ($g/m^2$) | Compound I ($g/m^2$) | Hardener DVS | Speed | Wet pressure lines | Dissolving Time in NaOH-sol (min.) | Water content ($g/m^2$) |
|---|---|---|---|---|---|---|---|
| 13 | 10.5 | 1.96 | 0.52 | 1.68 | 2.0 | 155.0 | 36.99 |
| 14 | 8.0 | 3.92 | 0.52 | 1.58 | 2.5 | 151.0 | 38.29 |
| 15 | 10.5 | 3.92 | 0.52 | 1.63 | 2.0 | 120.0 | 45.97 |
| 16 | 13.0 | 3.92 | 0.52 | 1.65 | 1.0 | 93.3 | 56.47 |

Table III clearly shows that increasing the hardening level (experiment 11 compared with 2) or presence of a higher gelatin content (compare experiments Nos. 3 and 2, and Nos. 12 and 11 respectively) improves wet pressure lines, at the expense of photographic speed.

Increasing the gelatin level also raises the water content: this may however result in drying problems.

A clear reduction of the sensitivity for wet pressure lines without speed loss or increased water content is thus obtained when a higher amount of hardener is applied in combination with the addition of compound I (dextran MW 10000): compare e.g. experiment No. 14 with experiment No. 2. Fine-tuning of the water content and wet pressure lines can be performed by adaptation of the gelatin level. The fact that the addition of compound I improves speed without altering the sensitivity for wet pressure lines was unexpected.

Example No. 2

Preparation of materials and test methods are same as in example 1. Hydrophilic polymer compound I was tested in comparison with the polyacrylamide polymers, amounts ($g/m^2$/side) given in Table IV (Compound II: polyacrylamide with MW=10000 (Aldrich™); compound III: MW=1500 (Aldrich™); compound IV: MW=2400 (SNF Floerger™).

TABLE IV

| mat. No. | Gelatin Emulsion Layer ($g/m^2$) | Hydrophilic Polymer Comp. | Hydrophilic Polymer ($g/m^2$) | Hardener DVS ($g/m^2$) | Speed | Wet pressure Lines | Dissolving Time NaOH (min.) | Water content ($g/m^2$) |
|---|---|---|---|---|---|---|---|---|
| 17 | 9.23 | Absent | 0.00 | 0.13 | 1.61 | 5.0 | 30.6 | 50.34 |
| 18 | 10.23 | Absent | 0.00 | 0.33 | 1.71 | 2.0 | 113.0 | 36.47 |
| 19 | 10.23 | I | 2.25 | 0.33 | 1.62 | 2.0 | 80.5 | 47.01 |
| 20 | 10.23 | I | 3.00 | 0.33 | 11.60 | 2.0 | 77.0 | 51.74 |
| 21 | 10.23 | II | 2.25 | 0.33 | 1.63 | 2.5 | 85.2 | 48.31 |
| 22 | 10.23 | II | 3.00 | 0.33 | 1.62 | 3.0 | 70.4 | 53.82 |
| 23 | 10.23 | III | 2.25 | 0.33 | 1.64 | 3.0 | 48.4 | 51.27 |
| 24 | 10.23 | III | 3.00 | 0.33 | 1.65 | 3.0 | 48.0 | 51.12 |
| 25 | 10.23 | IV | 2.25 | 0.33 | 1.59 | 3.5 | 51.2 | 55.58 |
| 26 | 10.23 | IV | 3.00 | 0.33 | 1.59 | 3.0 | 47.0 | 62.65 |

Data summarized in Table IV illustrate that increasing the hardener level (experiment No. 18 compared with No. 17) combined with a higher gelatin level, reduces the sensitivity for wet pressure lines, at the expense of photographic speed.

Addition of compounds I to IV, at high hardening level (0,33 $g/m^2$ DVS), gives a higher speed without deterioration of the sensitivity for wet pressure lines.

Having described in detail preferred embodiments of the current invention, it will now be apparent to those skilled in the art that numerous modifications can be made therein without departing from the scope of the invention as defined in the appending claims.

What is claimed is:

1. A silver halide industrial radiographic material comprising on at least one side of a support a hydrophilic gelatinous non-spectrally sensitized radiation-sensitive emulsion layer, having grains, coated in a total amount in the range from 6 to 20 g, expressed as an equivalent amount of silver nitrate per square meter, and at least one non-radiation sensitive protective gelatinous antistress overcoat layer thereupon, wherein a ratio of gelatin to silver, expressed as silver nitrate, in the said radiation sensitive layer is at least 0.70, wherein said gelatinous layers are hardened by a gelatin cross-linking agent in an amount in order to have a dissolving time of at least 40 minutes, said time being measured as time starting when immersing the material in an aqueous solution (1.5% by weight) of sodium hydroxide at 50° C. until the moment that the base becomes visible, characterized in that in the said hydrophilic gelatinous layer arrangement a hydrophilic polymer differing from gelatin is present in an amount of at least 1 g per $m^2$.

2. Material according to claim 1, wherein as gelatin cross-linking agent a vinyl sulfonyl hardening agent is present.

3. Material according to claim 2, wherein said vinyl sulfonyl hardening agent is bis-(vinyl-sulfonyl)-methane, present in an amount of at least 150 mg per $m^2$ and per side of the said material.

4. Material according to claim 1, wherein said hydrophilic polymer is selected from the group consisting of polysaccharides and polyacrylamides, having an average molecular weight of less than 100000.

5. Material according to claim 2, wherein said hydrophilic polymer is selected from the group consisting of polysaccharides and polyacrylamides, having an average molecular weight of less than 100000.

6. Material according to claim 3, wherein said hydrophilic polymer is selected from the group consisting of polysaccharides and polyacrylamides, having an average molecular weight of less than 100000.

7. Material according to claim 1, wherein said hydrophilic polymer is present in a weight ratio versus gelatin in the range from 1:10 to 1:2.

8. Material according to claim 2, wherein said hydrophilic polymer is present in a weight ratio versus gelatin in the range from 1:10 to 1:2.

9. Material according to claim 3, wherein said hydrophilic polymer is present in a weight ratio versus gelatin in the range from 1:10 to 1:2.

10. Material according to claim 4, wherein said hydrophilic polymer is present in a weight ratio versus gelatin in the range from 1:10 to 1:2.

11. Material according to claim 5, wherein said hydrophilic polymer is present in a weight ratio versus gelatin in the range from 1:10 to 1:2.

12. Material according to claim 6, wherein said hydrophilic polymer is present in a weight ratio versus gelatin in the range from 1:10 to 1:2.

13. Material according to claim 4, wherein said polysaccharide is dextran, having a molecular weight in the range from 1000 to less than 40000.

14. Material according to claim 5, wherein said polysaccharide is dextran, having a molecular weight in the range from 1000 to less than 40000.

15. Material according to claim 6, wherein said polysaccharide is dextran, having a molecular weight in the range from 1000 to less than 40000.

16. Material according to claim 7, wherein said polysaccharide is dextran, having a molecular weight in the range from 1000 to less than 40000.

17. Material according to claim 8, wherein said polysaccharide is dextran, having a molecular weight in the range from 1000 to less is than 40000.

18. Material according to claim 9, wherein said polysaccharide is dextran, having a molecular weight in the range from 1000 to less than 40000.

19. Material according to claim 10, wherein said polysaccharide is dextran, having a molecular weight in the range from 1000 to less than 40000.

20. Material according to claim 11, wherein said polysaccharide is dextran, having a molecular weight in the range from 1000 to less than 40000.

21. Material according to claim 12, wherein said polysaccharide is dextran, having a molecular weight in the range from 1000 to less than 40000.

22. Material according to claim 1, wherein said grains are grains or crystals, rich in silver bromide, having an average equivalent volume diameter of at least 0.40 $\mu$m.

23. Material according to claim 4, wherein said grains are grains or crystals, rich in silver bromide, having an average equivalent volume diameter of at least 0.40 $\mu$m.

24. Material according to claim 7, wherein said grains are grains or crystals, rich in silver bromide, having an average equivalent volume diameter of at least 0.40 $\mu$m.

25. Material according to claim 13, wherein said grains are grains or crystals, rich in silver bromide, having an average equivalent volume diameter of at least 0.40 $\mu$m.

26. Material according to claim 22, wherein said grains rich in silver bromide have iodide in an amount of less than 3 mole %, based on silver.

27. Material according to claim 23, wherein said grains rich in silver bromide have iodide in an amount of less than 3 mole %, based on silver.

28. Material according to claim 24, wherein said grains rich in silver bromide have iodide in an amount of less than 3 mole %, based on silver.

29. Material according to claim 25, wherein said grains rich in silver bromide have iodide in an amount of less than 3 mole %, based on silver.

30. Material according to claim 1, wherein said material is a double-side coated material.

31. Material according to claim 2, wherein said material is a double-side coated material.

32. Material according to claim 3, wherein said material is a double-side coated material.

33. Material according to claim 4, wherein said material is a double-side coated material.

34. Material according to claim 7, wherein said material is a double-side coated material.

35. Material according to claim 13, wherein said material is a double-side coated material.

36. Material according to claim 22, wherein said material is a double-side coated material.

37. Material according to claim 26, wherein said material is a double-side coated material.

38. Method of processing a material according to claim 1, wherein said material, after having been exposed to X-rays having an energy in the range from 10 keV to 4 MeV, is processed by the steps of developing, fixing, rinsing and drying, wherein said processing proceeds within a time of less than 5 minutes dry-to-dry.

39. Method of processing a material according to claim 2, wherein said material, after having been exposed to X-rays having an energy in the range from 10 keV to 4 MeV, is processed by the steps of developing, fixing, rinsing and drying, wherein said processing proceeds within a time of less than 5 minutes dry-to-dry.

40. Method of processing a material according to claim 3, wherein said material, after having been exposed to X-rays having an energy in the range from 10 keV to 4 MeV, is processed by the steps of developing, fixing, rinsing and drying, wherein said processing proceeds within a time of less than 5 minutes dry-to-dry.

41. Method of processing a material according to claim 4, wherein said material, after having been exposed to X-rays having an energy in the range from 10 keV to 4 MeV, is processed by the steps of developing, fixing, rinsing and drying, wherein said processing proceeds within a time of less than 5 minutes dry-to-dry.

42. Method of processing a material according to claim 7, wherein said material, after having been exposed to X-rays having an energy in the range from 10 keV to 4 MeV, is processed by the steps of developing, fixing, rinsing and drying, wherein said processing proceeds within a time of less than 5 minutes dry-to-dry.

43. Method of processing a material according to claim 13, wherein said material, after having been exposed to X-rays having an energy in the range from 10 keV to 4 MeV, is processed by the steps of developing, fixing, rinsing and drying, wherein said processing proceeds within a time of less than 5 minutes dry-to-dry.

44. Method of processing a material according to claim 22, wherein said material, after having been exposed to X-rays having an energy in the range from 10 keV to 4 MeV, is processed by the steps of developing, fixing, rinsing and drying, wherein said processing proceeds within a time of less than 5 minutes dry-to-dry.

45. Method of processing a material according to claim 26, wherein said material, after having been exposed to X-rays having an energy in the range from 10 keV to 4 MeV, is processed by the steps of developing, fixing, rinsing and drying, wherein said processing proceeds within a time of less than 5 minutes dry-to-dry.

46. Method of processing a material according to claim 30, wherein said material, after having been exposed to X-rays having an energy in the range from 10 keV to 4 MeV, is processed by the steps of developing, fixing, rinsing and drying, wherein said processing proceeds within a time of less than 5 minutes dry-to-dry.

* * * * *